US008044328B2

(12) United States Patent
Boss

(10) Patent No.: US 8,044,328 B2
(45) Date of Patent: Oct. 25, 2011

(54) COOKTOP

(75) Inventor: Roland Boss, Walzbachtal-Jöhlingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 947 days.

(21) Appl. No.: 12/017,844

(22) Filed: Jan. 22, 2008

(65) Prior Publication Data

US 2008/0173634 A1 Jul. 24, 2008

(30) Foreign Application Priority Data

Jan. 22, 2007 (DE) ..... 20 2007 001 432 U

(51) Int. Cl.
*H05B 3/68* (2006.01)
*F24C 15/10* (2006.01)

(52) U.S. Cl. ..... 219/451.1; 126/211

(58) Field of Classification Search .... 219/451.1–456.1, 219/536; 126/211, 217; 99/339, 340, 422, 99/445

See application file for complete search history.

(56) References Cited

U.S. PATENT DOCUMENTS 3,500,087 A * 3/1970 Wendt ..... 310/90
6,664,519 B2 12/2003 Hammelsbacher et al.
6,888,107 B2 * 5/2005 McFarland ..... 219/452.12
7,274,008 B2 * 9/2007 Arnal Valero et al. ..... 219/622
7,595,466 B2 * 9/2009 Huber ..... 219/452.11

FOREIGN PATENT DOCUMENTS

AU 2006200722 A1 9/2006
DE 10003410 8/2001
DE 102004023788 12/2005
WO WO 2006/134556 A2 12/2006

OTHER PUBLICATIONS

German Search Report from German Application No. 20 2007 001 432.5.

* cited by examiner

*Primary Examiner* — Sang Paik
(74) *Attorney, Agent, or Firm* — Alston & Bird LLP

(57) ABSTRACT

A cooktop has a metal support plate upon which heating equipment can be mounted and a control casing for housing or attaching a control unit or electronics. Fasteners allow for detachable connection of the metal support plate and the control casing to each other, and comprise fastenings formed on the metal support plate and corresponding slots on the control casing, whereby the fastenings are designed for attachment into the slots in an attachment orientation whereby movement of the two parts relative to each other results in the final assembled state. There is a moveable protrusion on the control casing and a recess or catch on the metal support plate that mates with the protrusion. During movement of the support plate and control casing into the final assembled position, the protrusion interacts with the catch or recess to lock the metal support plate relative to the control casing.

19 Claims, 3 Drawing Sheets

COOKTOP

CROSS REFERENCE TO RELATED APPLICATIONS

This application claims priority to German Application Number 20 2007 001 432.5 filed on Jan. 22, 2007, the contents of which are incorporated by reference.

FIELD OF THE INVENTION

The invention concerns a cooktop, and more specifically, a means for fastening two portions of a cooktop in a lockable, but yet releasable, manner.

BACKGROUND OF THE INVENTION

Usually with cooktops, such as induction cooktops, heating equipment is attached to the cooktop's metal support plate. Under this metal support plate, a control casing is affixed, which holds the controls or electronics for the cooktop. Fasteners are provided to connect the metal support plate and control casing as two detachable parts during assembly of the cooktop. Usually the control casing is screwed onto the metal support plate, for example with four metal screws at the corners of the control casing as fasteners. This step of screwing the parts together is relatively time consuming, which slows down and makes assembly of cooktop more difficult.

The invention addresses the problem of creating the type of cooktop named at the beginning, with which problems of the present assembly technology can be avoided and especially with which the assembly of the cooktop is made quicker and easier, and allows the detachment of the metal support plate and control casing.

BRIEF DESCRIPTION OF THE DRAWINGS

An example embodiment of the invention is presented schematically in the drawings and will be more closely described as follows, wherein.

DETAILED DESCRIPTION

Figures 1A, 1B:
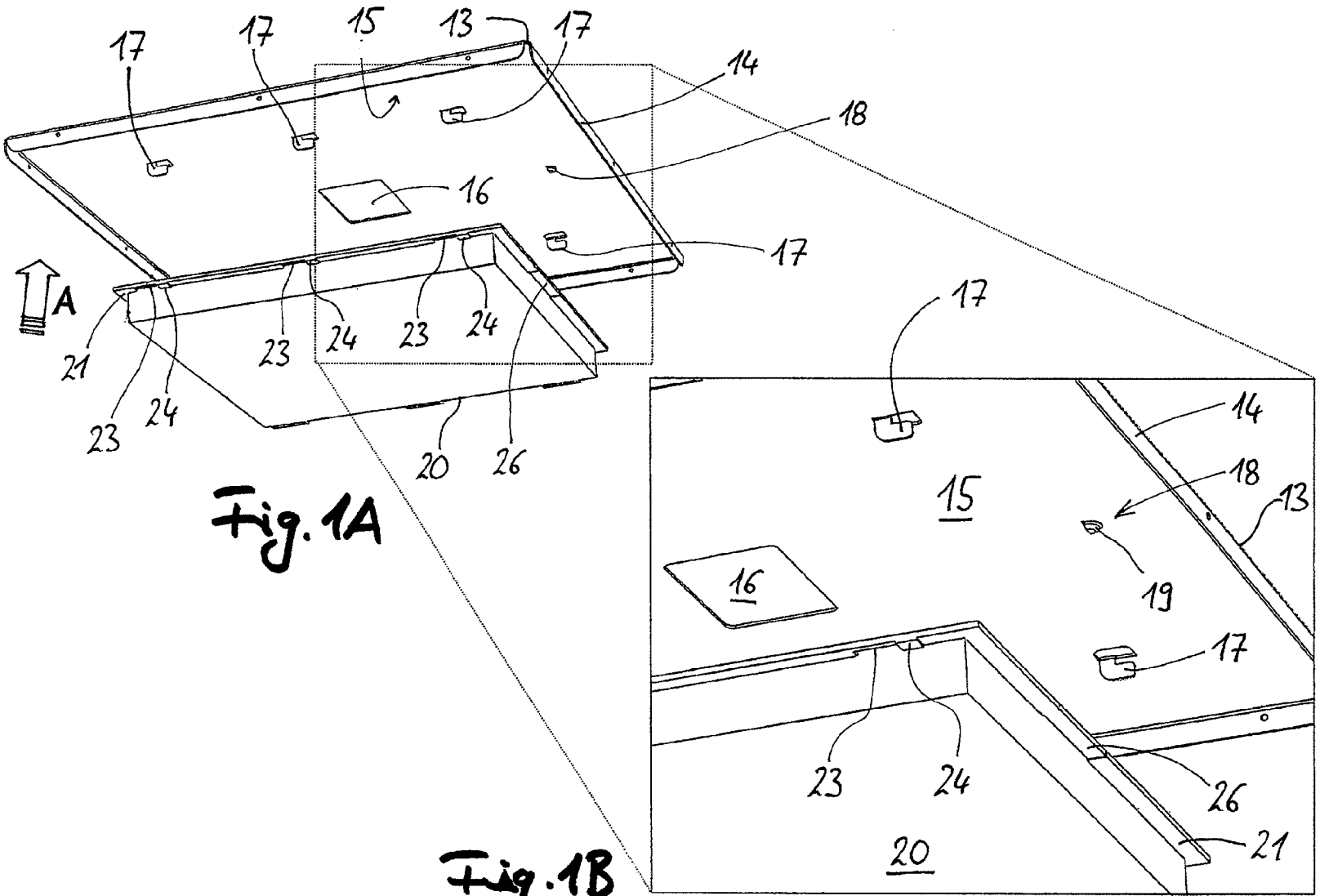
FIG. 1A illustrates a part of a cooktop in the form of a metal support plate and a control casing not yet attached.
FIG. 1B illustrates an enlargement of a portion from FIG. 1A.

One embodiment of a solution of this problem can be found in a cooktop with characteristics of claim 1. Advantageous as well as preferable designs for the invention are subject to further claims and will be explained more closely below. The wording of the claims will be used in the description of the content through express reference.

According to one embodiment of the invention, fastenings and appropriate slots (or cuts formed in the shape of slits) are provided for the metal support plate and the control casing respectively. Fastenings are provided on one part, and cuts or slots on the other part. In some embodiments, both parts can have both fastenings and slots. The fastenings are equipped for attachment on or in the slots of the other part, whereby the attachment of both parts is carried out in a so-called attachment orientation. Furthermore, the fastenings and slots are also equipped so that both parts can be moved relative to each other into a final assembly orientation. In this way, the actual connection is produced when both parts are oriented towards each other in the final assembled position. In order to prevent movement in the reverse direction, or in other words, movement of the metal support plate and the control casing so as to disassemble the two components, there are provided, one on each respective part, a moveable protrusion and a catch. The catch can take the form of a recess or projection for the protrusion. During the movement of both parts into the end position, the protrusion moves to, or into the catch, in the case of a recess, or over and above the catch, in case of a projection. In this way, the end position effects a sort of locking mechanism with the catch. Preferably, the moveable protrusion is located on the control casing and the catch is located on the metal support plate, particularly as a projection.

Essentially, the control casing and the metal support plate can be arranged in the attachment orientation in an embodiment of the invention, whereby the fastenings grip into the slots. Through movement in the end position, the fastenings and the slots connect and lock into position. Once both parts are in the final position of the assembly or connection, the moveable protrusion and the catch forms a locking system that prevents the parts from detaching. This type of locking is reversible allowing for repairs, for example, particularly by bending back the protrusion from the catch. This allows other means of attachment such as screws to be foregone, at least for producing the connection itself.

It is possible to prepare the protrusion to be pre-stressed or flexible so that it works together with the catch on its own. Particularly, it can slide into the lock, for example, upon movement of both parts into the final assembled position. Especially advantageous is preparing the moveable protrusion as a kind of long flexible tongue. The catch can come out from a projection standing out from the other part or a further protrusion. When attaching both parts to each other in the attachment orientation, the moveable protrusion can be in front of the projection and then be moved over the projection and grasp behind it with a type of locking. For this to occur, the direction of movement of the moveable protrusion is most advantageously diagonal or perpendicular to the end orientation. For such independent movement of the moveable protrusion over the projection, the projection can have a beveling on the side, onto which the protrusion rests once attached and then upon movement of both parts in the end orientation over the projection, by bending away so to speak. On the other side, on which the moveable protrusion in the end position rests, the projection should be straight, or not have any beveling, so that a reverse movement is only possible by bending the tongue away.

In a further embodiment of the invention, in addition to an automatic (under the circumstances) connection between the catch and the moveable protrusion, detachable means of fastening can be provided, for example screws or bendable plates with which the moveable protrusion can be attached on, or behind the catch, to prevent reverse movement.

In a further embodiment of the invention, a locking between the moveable protrusion and the catch is provided so that it is only accessible from the side of the metal support plate opposite the control casing. Here, it is especially advantageous that the catch is a recession or depression in the metal support plate and the moveable protrusion is pressed into this for locking and can be forced out manually or with machine, in case the locking does in fact need to be undone in order to detach the two parts from each other.

Preferably, the fastenings are provided on the metal support plate and the respective slots on the control casing, particularly on a wide edge that stands out from the control casing and rests flat against the metal support plate. It is preferable to have several slots on two sides of the control casing and the respective fastenings, for a secure and generally stable attachment of the metal support plate onto the control casing. It is advantageous to have the fastenings on one part and the slots on the other, whereby the fastenings and slots can be identically prepared.

In order to further simplify the assembly and make it more secure, the fastenings and respective slots are distributed and arranged so the control casing can only be attached to the metal support plate in a single possible position. This helps avoid mix-ups during assembly and possible later repairs.

In further embodiment of the invention, it can be provided that the fastenings and the slots are prepared so that the slit-shaped cuts have a certain leeway when sliding in the fastenings, which enables a certain tolerance (or lack thereof) of precision during the attachment process. Particularly, the slots can be somewhat wider and a good bit longer than the fastenings. Furthermore, they should be so prepared that when moving the two parts from the end orientation into the final position the leeway becomes less, or at least ensures stability in the final assembled position. This is possible through slants and thickened portions ("thickenings") in the area behind the cuts on which the fastenings rest during movement into the end position.

In further embodiment of the invention, it is possible that the moveable protrusion comes to rest against a projection as a catch when the fastenings are sliding into the slots or, in other words, when the control casing is being attached to the metal support plate. The tension of the protrusion can be overcome during attachment, so that the protrusion bends back appropriately. If the control casing in the end orientation is then moved to the metal support plate in the end position, the moveable protrusion grasps or snaps behind the projections and forms the lock.

The metal support plate can be larger than the control casing, two to five times larger, for example. Furthermore, it is advantageous to attach the control casing somewhat in the middle or center of the metal support plate and to have it in the same shape. Both parts can be produced most advantageously out of metal, but particularly the metal support plate.

These and further characteristics are found not only in the claims, but also from the description and drawings, whereby the individual features can be carried out alone or in combination with other features in the invention. The division of the application into separate sections as well as sub-headings does not restrict the general applicability of the statements made under them.

FIG. 1A shows the cooktop, during the assembly of a metal support plate 13 and a control casing 20. The metal support plate 13 has a rim 14 crimped downward, that surrounds an underside 15. The underside 15 has a central opening 16 for connections between a control in the control casing 20 and heat equipment or induction spools that are laid on top of the metal support plate 13, which are not shown here in the figure. Furthermore, the underside 15 on the metal support plate 13 has several exposed fastenings 17 that point towards the right as well as a projection 18. From the enlargement in FIG. 1B, it can be seen that the fastenings 17 are designed with the same shape and are similarly positioned for a particular direction. Furthermore, it can be recognized that the projection 18 has a slant 19 on the right side, while on the left it stands out at a right angle from the metal support plate 13.

Around the control casing 20, with a likewise rim 21 that stands out from the side, there are slots 23 in the form of slits cut in the rim 21 near the control casing 20, namely six cuts 23 along the two longer sides of the control casing 20. To the right next to the cuts 23, the rim 21 has thickenings 24. This is easy to see in FIG. 1B. This will be discussed further later.

On the control casing's 20 right-pointing facing there is a flexible tongue 26. This is bendable along the dotted line from the other rim 21 and divided from the rim 21 by the solid line. This is more clearly visible in FIG. 2B.

The control casing 20 is arranged in the attachment orientation A according to FIG. 1A on the metal support plate 13 or the other way around. In the control casing 20 is the control or electronics.

Figures 2A, 2B:
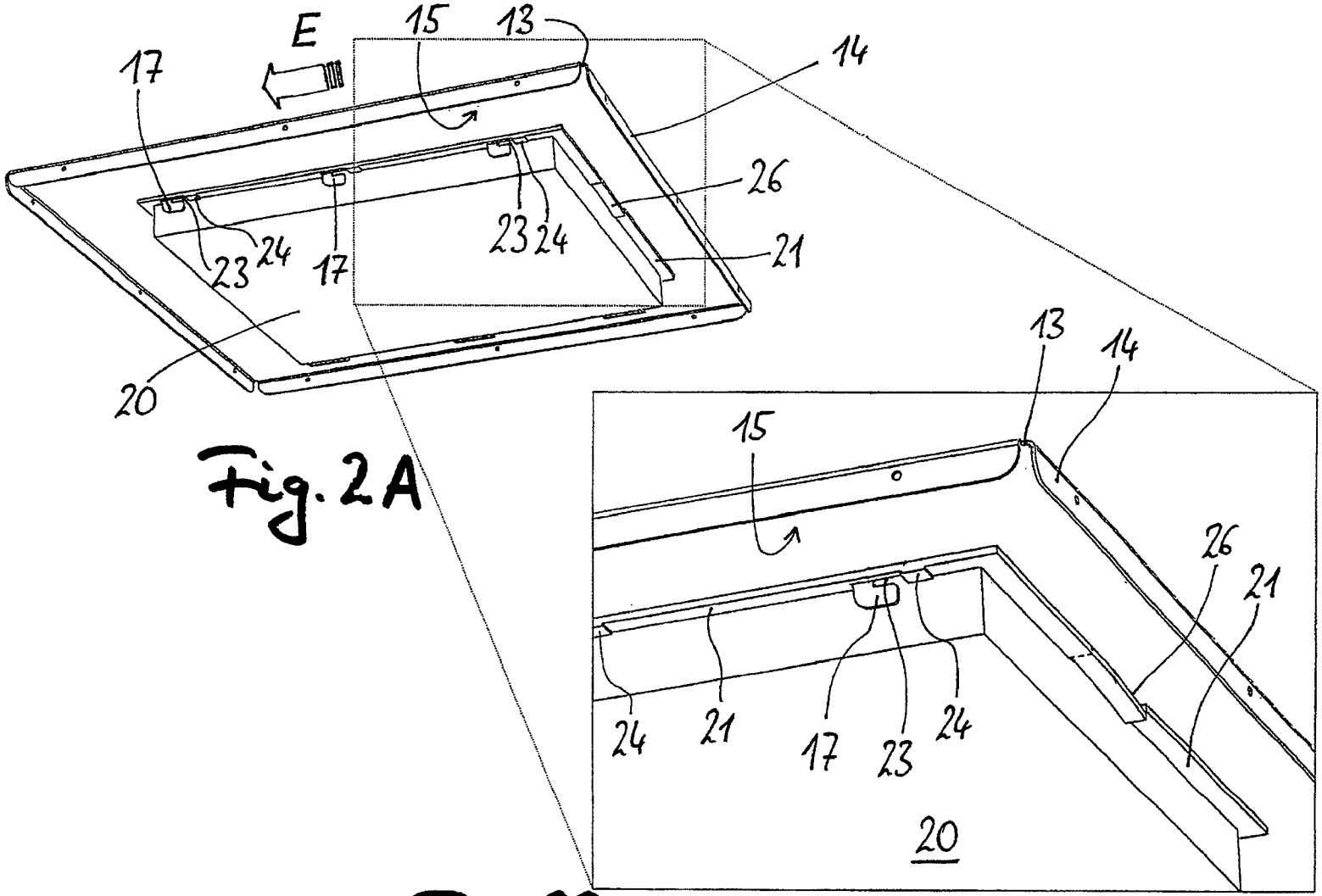
FIG. 2A illustrates both parts from FIG. 1A in an attached state.
FIG. 2B illustrates an enlargement of a portion from FIG. 2A.

In FIG. 2A, it is shown how the control casing 20 is attached to the metal support plate 13 in the attachment orientation A according to in FIG. 1A. All fastenings 17 grasp through the respective slots 23 into the control casing 20 or into its rim 21. As seen in enlargement in FIG. 2B, when attaching the flexible tongue 26, it comes to rest exactly on the projection 29 or with the upper left edge shown in FIG. 2B in the area of the slanting. For this reason, it is bent on the lower right end of the rim 21 (at the dotted line).

Now the control casing 20 is moved along the direction E according to FIG. 2A after it contacts the metal support plate 13 or vice versa. After this movement, the cooktop is positioned in the final assembly position, according to FIG. 3A. Viewing the enlargement of FIG. 3B, it can be recognized how the fastenings 17 do not just grasp any area of the rim 21 on the end of the slots, but instead grasp right at the thickenings 24. This secures a good attachment of the control casing 20 to the underside 15 of the metal support plate 13, especially when the thickenings 24 from the slots 23 become thicker.

Figures 3A, 3B:
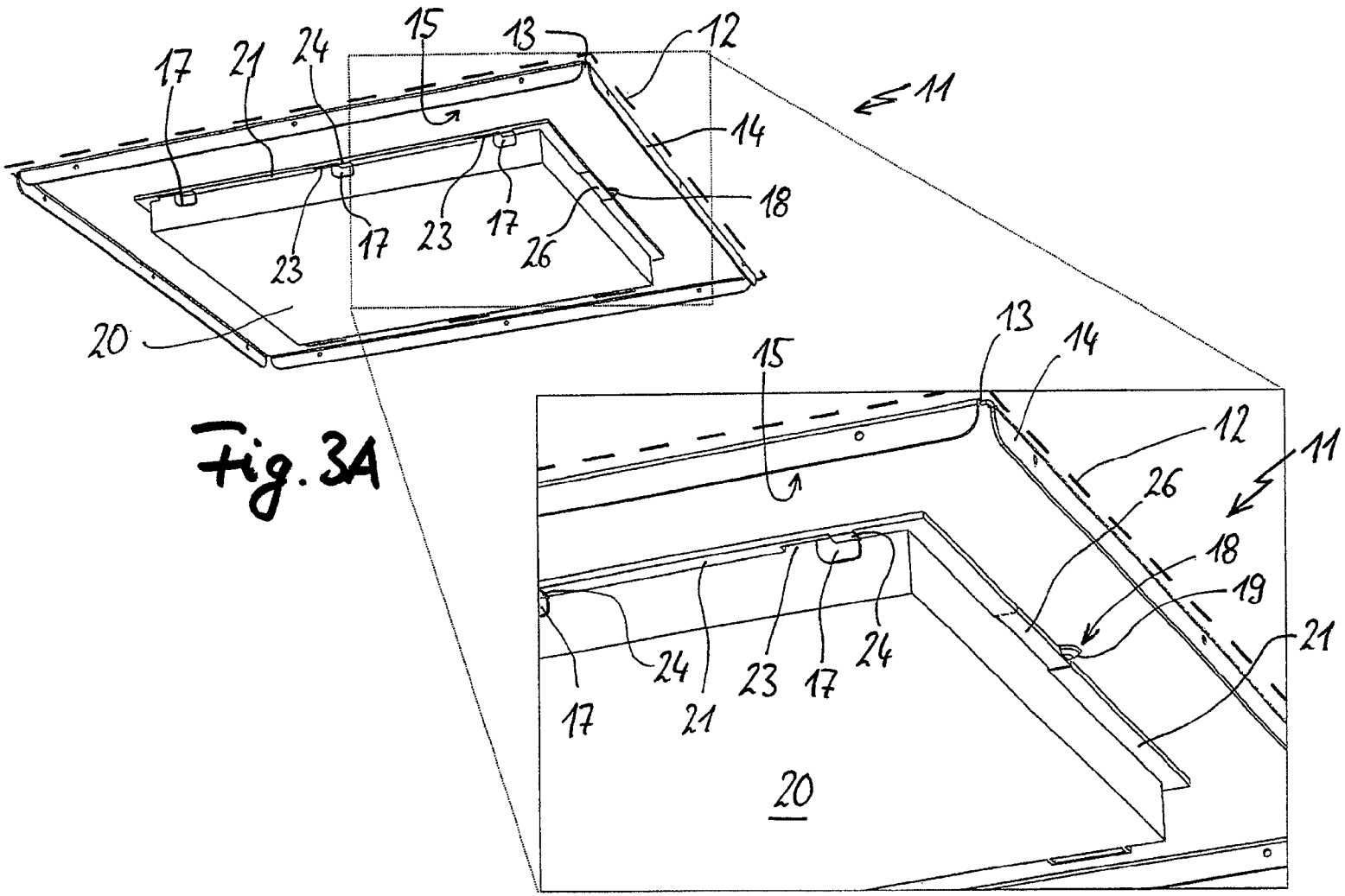
FIG. 3A illustrates both parts from FIG. 2A through the movement from the end orientation into the end position, and FIG. 3B an enlargement of a portion from FIG. 3A.

Furthermore, it can be recognized in FIG. 3B that the flexible tongue 21 snaps into position behind the projection 18, or rests next to it, and the flexible tongue essentially rests flat against the metal support plate 13. Since the projection 18 has no slants, the flexible tongue 26 cannot slip over the projection 18 when the control casing 20 is moved against the end orientation 26 and in this way a lock is formed that cannot detach automatically. This prevents the two parts from detaching by merely being pushed against each other. The projection 18 forms the lock described above.

It is recognized from FIGS. 2B and 3B that the rim 21 of the control casing 20 has a certain flexibility or bendability in the location of a separate flexible tongue 26. This allows the tongue 26 to be bent when the control casing 20 is being attached to the metal support plate 13. This allows the tongue to ride over the projection 18 during assembly and to snap into its regular position behind the projection 18 to lock the control casing 20 in position.

Detaching the control casing 20 can be carried out by bending the flexible tongue 26 away from the metal support plate 13 and thereby no longer letting it rest against the projection 18 (essentially unlocking it). A hole through the metal support plate 13 can additionally be provided, next to the projection 18, through which the flexible tongue 26 can be pushed away from the projection 18 with a penetrating tool.

Likewise in FIG. 3B, those skilled in the art may see that instead of the projection 18, a larger opening in the metal support plate 13 could be provided on which the flexible tongue 26 rests. This flexible tongue 26 can be pressed or slid upwards into the recess of the metal support plate 13 either of its own accord or with a tool so that there the lock will not detach on its own. A disadvantage would be circumstances under which the flexible tongue extends over the upper edge of the metal support plate 13 and is in the way.

FIG. 3A represents a glass ceramic plate 12 using dashed lines. This is brought up for the cooktop 11 on the metal support plate 13 when the induction spools are brought up on the upper side of the metal support plate 13. A mainly mechanical linkage between the glass ceramic plate 12 and the metal support plate 13 can be produced with a outer rim, clamp or other mechanism not shown here.

In FIG. 3B it is likewise easy for those skilled in the art to see how the flexible tongue 26 can be connected to the metal support plate 13, for example, by means of a metal screw, either from above first through the metal support plate 13 or from underneath first through the flexible tongue 26. Further means of fastening are easily viable.

The advantage of attaching the fastenings 17 to the metal support plate 13 or accordingly to its underside 15 and the cuts 23 to the rim 21 or accordingly to the control casing 20 lies in the fact that the upper side of the metal support plate 13 can be made completely even and without extending parts. This allows the addition of heating equipment, especially induction heating equipment, to be particularly simple.

The invention claimed is:

1. A cooktop comprising:

a metal support plate on which to assemble heating equipment;

a control casing for a control unit or electronics;

wherein one of the metal support plate or the control casing includes a plurality of cooktop fastenings formed therewith, and the other of the metal support plate or the control casing includes a plurality of slots cut therein, whereby said cooktop fastenings allow a detachable connection of the metal support plate with the control casing, whereby the metal support plate and control casing are two parts that in an assembled state of the cooktop are connected with one another, whereby the fastenings are designed for the attachment to the slots in an attachment orientation and with a movement of the metal support plate and the control casing relative to each other in an assembly orientation direction into a final assembled position, whereby a moveable protrusion from one of the metal support plate or control casing is provided and a catch in the form of a projection for the protrusion is provided on the other of the metal support plate or control casing, whereby upon movement into the final assembled position, the protrusion moves over the catch, and in the final assembled position works together with the catch as to form a lock to prevent reverse movement out of the final assembled position that would allow detachment of the metal support plate and control casing from each other.

2. The cooktop according to claim 1, distinguished by the pre-stressing or flexibility of the moveable protrusion for automatic interaction with the catch.

3. The cooktop according to claim 2, distinguished by the pre-stressing or flexibility of the moveable protrusion for automatic sliding into the catch.

4. The cooktop according to claim 3, characterized in that the moveable protrusion is a flexible tongue and the catch is a projection, whereby in the final assembled position the flexible tongue contacts the projection to form a lock and the point of contact of the protrusion with the catch is diagonal or perpendicular to the end orientation of the metal support plate.

5. The cooktop according to claim 4, characterized in that the projection has a slant on the side pointing away from the protrusion in the final assembly position to facilitate movement of the protrusion over the projection when moving the metal support plate and control casing in the end orientation.

6. The cooktop according to claim 5, characterized in that the projection is straight on the side facing towards the protrusion to prevent movement in the final assembly position.

7. The cooktop according to claim 1, characterized in that the moveable protrusion comes to rest against the catch in the form of a projection when sliding the fastenings into the respective slots.

8. The cooktop according to claim 1, characterized in that the moveable protrusion is locked in the final assembled position so as to prevent a reverse movement.

9. The cooktop according to claim 8, characterized in that the moveable protrusion is attached using screws or bendable clips.

10. The cooktop according to claim 1, characterized in that the moveable protrusion is on the control casing and the catch is on the metal support plate.

11. The cooktop according to claim 1 characterized in that locking between the moveable protrusion and the catch is only accessible from one side of the metal support plate.

12. The cooktop according to claim 1, characterized in that the fastenings are on the metal support plate and the respective slots are on the control casing.

13. The cooktop according to claim 12, characterized in that a plurality of slots are on at least two sides of the control casing.

14. The cooktop according to claim 1, characterized in that the distribution of the fastenings and corresponding slots is such that the metal support plate and control casing are only attachable to each other in one possible position.

15. The cooktop according to claim 1, characterized in that the fastenings and the slots are formed such that when sliding the fastenings into the slots there is a greater leeway between the fastenings and the slots compared to the final assembly position.

16. The cooktop according to claim 15, characterized in that a thickening is positioned near each slot such that the fastenings and the slots in the final assembled position mate securely and without leeway.

17. The cooktop according to claim 1, wherein the protrusion is configured to allow unlocking of the metal support plate and the control casing.

18. A cooktop comprising:

a metal support plate on which to assemble heating equipment, said metal support plate having a plurality of fastenings formed therewith, said fastenings each having a common shape, said shape comprising an "L" shape perpendicular to said support plate, said plurality of fastenings located in a position forming at least two parallel rows of fasteners;

a control casing for housing a control unit of said cooktop comprising a rim, said rim having a plurality of slots corresponding to said position of said fasteners, whereby said plurality of fasteners are designed to be inserted into said plurality of respective slots in an attachment orientation and upon a movement in a first direction of the metal support plate relative to the control casing into a final assembly position, said plurality of said fasteners mate with said plurality of slots so as to attach said metal support plate with said control casing;

a moveable protrusion formed on said control casing; and a catch on said metal support plate, whereby said moveable protrusion slides over said catch when moving said metal support plate relative to the control casing into said final assembly position in said first direction, and said moveable protrusion contacts said catch in said final assembly position so as to prevent movement of said metal support plate in a direction reverse to said first direction relative to said control casing.

19. A cooktop comprising:

a metal support plate on which to assemble heating equipment, said metal support plate having a plurality of fastenings formed therewith;

a control casing for a control unit or electronics comprising a plurality of slots cut into the control casing, whereby said fastenings allow a detachable connection of the metal support plate with the control casing, whereby the metal support plate and control casing are two parts that in an assembled state of the cooktop are connected with one another, whereby the fastenings are designed for the entering the slots in an attachment orientation of the metal support plate and the control casing in which the fastenings and slots align, allowing a movement of the metal support plate and the control casing relative to each other in an assembly orientation direction into a final assembled position, whereby a moveable protrusion from the control casing is provided and a catch in the form of a projection for the protrusion is provided on the metal support plate, whereby upon movement into the final assembled position, the protrusion moves over the catch, and in the final assembled position works together with the catch as to form a lock to prevent reverse movement out of the final assembled position.

* * * * *